US006631253B2

(12) United States Patent
Nakafuji et al.

(10) Patent No.: US 6,631,253 B2
(45) Date of Patent: Oct. 7, 2003

(54) FIXING DEVICE AND IMAGE FORMING APPARATUS USING THE SAME

(75) Inventors: Atsushi Nakafuji, Yokohama (JP); Takashi Fujita, Tokyo (JP); Hirokazu Ikenoue, Inagi (JP); Jun Yura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/021,503

(22) Filed: Dec. 19, 2001

(65) Prior Publication Data

US 2002/0076243 A1 Jun. 20, 2002

(30) Foreign Application Priority Data

Dec. 20, 2000 (JP) ..... 2000-387303
Nov. 29, 2001 (JP) ..... 2001-364106

(51) Int. Cl.[7] ..... G03G 15/20
(52) U.S. Cl. ..... 399/329
(58) Field of Search ..... 399/307, 320, 399/328, 329, 335, 338; 219/216

(56) References Cited

U.S. PATENT DOCUMENTS 5,493,365 A 2/1996 Matsui et al.
5,592,275 A 1/1997 Echigo et al.
5,678,161 A 10/1997 Kurotaka et al.
5,708,949 A 1/1998 Kasahara et al.
5,907,348 A * 5/1999 Ogasawara et al. ..... 399/329 X
5,920,757 A * 7/1999 Izawa et al. ..... 399/329
5,923,930 A 7/1999 Tsukamoto et al.
6,026,272 A * 2/2000 Kusaka et al. ..... 219/216 X
6,040,558 A * 3/2000 Yamazaki ..... 219/216
6,055,390 A 4/2000 Kurotaka et al.
6,078,766 A 6/2000 Kurotaka
6,088,558 A 7/2000 Yamada et al.
6,108,906 A 8/2000 Fujita et al.
6,115,576 A 9/2000 Nakano et al.
6,122,479 A 9/2000 Fujita et al.
6,175,713 B1 * 1/2001 Uehara et al. ..... 399/307
6,198,888 B1 3/2001 Kurotaka et al.
6,243,559 B1 6/2001 Kurotaka et al.
6,262,787 B1 7/2001 Kamoi et al.
6,295,435 B1 9/2001 Shinohara et al.
6,347,212 B1 2/2002 Kosugi et al.
6,366,751 B1 4/2002 Shakuto et al.
6,449,457 B2 * 9/2002 Samei et al. ..... 399/328

FOREIGN PATENT DOCUMENTS

JP 8-262895 10/1996
JP 8-335000 12/1996
JP 9-212016 8/1997
JP 2000-131975 5/2000

* cited by examiner

*Primary Examiner*—Sandra Brase
(74) *Attorney, Agent, or Firm*—Oblon, Spivak, McClelland, Maier & Neustadt, P.C.

(57) ABSTRACT

A fixing device for fixing a toner image formed on a recording medium conveyed to a nip for fixation of the present invention includes a rotary body, a stationary heating member not forming the nip, a fixing belt passed over the rotary body and heating member, and a pressing member held in contact with the fixing belt. A resistance heating body is formed on the heating member with the intermediary of an electric insulation layer.

28 Claims, 13 Drawing Sheets

FIXING DEVICE AND IMAGE FORMING APPARATUS USING THE SAME

BACKGROUND OF THE INVENTION

1. Field of the Invention

The present invention relates to a fixing device for fixing a toner image formed on a sheet or recording medium conveyed to a nip for fixation, and an image forming apparatus using the same.

2. Description of the Background Art

An electrophotographic copier, printer, facsimile apparatus, multifunction machine or similar image forming apparatus often includes a fixing device of the type using a heat roller and a press roller. The heat roller or rotary body and press roller or pressing means are pressed against each other, forming a nip for fixation therebetween. When a sheet carrying a toner image thereon is brought to the nip, the heat roller being heated and press roller cooperate to fix the toner image on the sheet with heat and pressure.

Another conventional fixing device includes a fixing belt passed over a heat roller and a driven roller. A press roller facing the driven roller and belt form a nip for fixation therebetween. This type of fixing device insures sufficient pressure for fixation and maintains the nip stable.

It is a common practice with an image forming apparatus to shut off power supply to, e.g., a fixing heater when the apparatus is not used for a saving power purpose. The prerequisite with an energy saving type of fixing device using a heat roller is that the surface of the heat roller be immediately heated to temperature high enough to melt toner. To meet this prerequisite, it has been customary with a fixing device of the type disposing a halogen lamp in the heat roller to use a plurality of lamps for reducing the wall thickness of the heat roller to 1 mm or less and in consideration of a heat distribution.

Another conventional fixing device includes a planar heating member for heating a fixing roller and a resistance heating body formed on the heating member with the intermediary of an electric insulation layer. This type of fixing device has higher heat conversion efficiency and shorter warm-up time than the fixing device using lamps. A problem particular to such a rapid warm-up fixing device is that temperature rises at opposite ends of the heating member. However, this problem relating to a temperature distribution can be easily solved at low cost if the resistance heating body is divided into segments that can be controlled independently of each other. Generally, the resistance heating body extends in the axial direction of the fixing roller at the outside or the inside of the fixing roller. Power is fed to the resistance heating body via a terminal member affixed to the heating member, which extends as far as the opposite ends of the fixing roller. The terminal member contacts a metallic brush and slidingly moves in the circumferential direction. This type of fixing device is taught in, e.g., Japanese Patent Laid-Open Publication Nos. 62-200380 and 62-24288. Japanese Patent Laid-Open Publication No. 09-197853 discloses a fixing device that applies the planar heating member for heating the heat roller of a belt type fixing system. This fixing device also uses sliding contact for feeding power to a resistance heating body.

The fixing device of the type using a terminal and brush scheme has the following problems left unsolved. Because the resistance heating body (terminal) rotates, both the brush and terminal wear and produce dust and have surfaces roughened. This reduces the life of the brush and brings about noise due to spark discharge, lowering the reliability of the fixing device. Further, when the resistance heating body is divided in segments that are controlled independently of each other, the terminal portion becomes sophisticated due to the rotation of the heating bodies. The fixing device using a plurality of halogen lamps in consideration of a heat distribution is undesirable from the cost standpoint.

Technologies relating to the present invention are also disclosed in, e.g., Japanese Patent Laid-Open Publication Nos. 8-262895, 8-335000, 9-212016 and 2000-131975.

SUMMARY OF THE INVENTION

It is an object of the present invention to provide a stably operable, long-life fixing device structurally free from wear dust and spark discharge, and an image forming apparatus using the same.

It is another object of the present invention to provide a stably operable, long life fixing device making most of the merits of a planar heating member and obviating wear dust and spark discharge ascribable to friction, and an image forming apparatus using the same.

In accordance with the present invention, a fixing device for fixing a toner image formed on a recording medium conveyed to a nip for fixation includes a rotary body, a stationary heating member not forming the nip, a fixing belt passed over the rotary body and heating member, and a pressing member held in contact with the fixing belt. A resistance heating body is formed on the heating member with the intermediary of an electric insulation layer.

An image forming apparatus using the fixing device described above is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
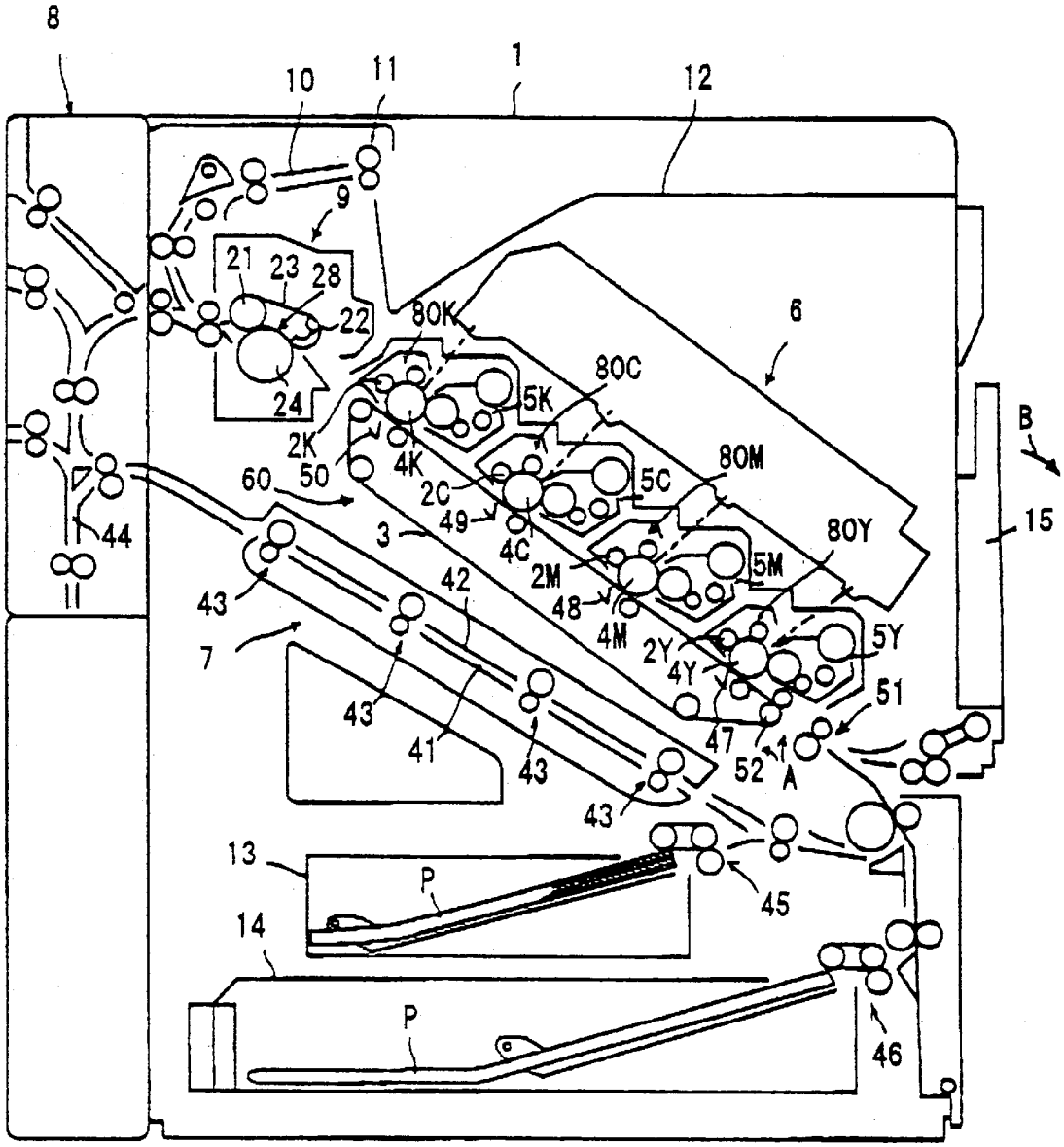
FIG. 1 is a view showing an image forming apparatus to which the present invention is applied.

Referring to FIG. 1 of the drawings, an image forming apparatus to which the present invention is applied is shown and implemented as an electrophotographic full-color printer by way of example. As shown, the printer includes a plurality of drum units or image carrier units 2Y (yellow), 2M (magenta), 2C (cyan) and 2K (black), which are removably mounted to an apparatus body 1. Image transferring means 60 including a belt 3 is positioned substantially at the center of the apparatus body 1. The belt 3 plays the role of an image transfer member and a sheet support member. The belt 3 is passed over a plurality of rollers and movable in a direction indicated by an arrow A; a torque is transmitted to one of the rollers. The belt 3 is held in contact with photoconductive drums or image carriers 4Y, 4M, 4C and 4K. The image transferring means 60 uses a contact type of image transferring system.

The drum units 2Y through 2K, which respectively include the drums 4Y through 4K, are positioned above the belt 3. The drum units 2Y through 2K are arranged in this order such that the drum units 2Y and 2K adjoin a sheet feed side and a fixing device 9, respectively. The drums 3Y through 4K may be replaced with photoconductive belts, if desired.

Developing devices or developing means 5Y, 5M, 5C and 5K face the drums 4Y, 4M, 4C and 4K, respectively, and each stores a two-ingredient type developer of a particular color. The two-ingredient type developer is a mixture of, e.g., yellow, magenta, cyan or black toner and carrier. The developing devices 5Y through 5K each deposit the respective developer on a latent image formed on associated one of the drums 4Y through 4K to thereby develop the latent image.

An optical writing unit or exposing means 6 is positioned above the drum units 2Y through 2K. A duplex print unit 7 is disposed below the drum units 2Y through 2K. Sheet cassettes 13 and 14 are located below the duplex print unit 7, and each is loaded with a stack of sheets or recording media P of particular size. A reversing unit 8 is arranged at the left-hand side of the printer body 1. A manual feed tray 15 is mounted on the right side of the printer body 1 and openable in a direction indicated by an arrow B in FIG. 1. A reversal path 10 is arranged downstream of the fixing device 9 in the direction of sheet feed. An outlet roller pair 11 is positioned on the reversal path 10 for driving the sheet P out of the printer body 1 to a print tray 12.

Chargers or charging means 80Y, 80M, 80C and 80K are respectively included in the drum units 2Y, 2M, 2C and 2K for uniformly charging the associated drums 4Y, 4M, 4C and 4K. The drum units 2Y through 2K are identical in configuration, and so are the chargers 80Y through 80K. The chargers 80Y through 80K are implemented as conventional charge rollers contacting the drums 4Y through 4K, respectively.

The duplex print unit 7 includes a pair of guides 41 and 42 and a plurality of roller pairs 43. In a duplex print mode for forming images on both sides of the sheet P, the sheet P carrying an image on one side thereof is switched back by the reversal path 44 of the reversing unit 8 and reversed thereby. The sheet P is then introduced into the duplex print unit 7. The duplex print unit 7 again conveys the sheet P to an image transfer position between the drum 4Y and the belt 3.

The reversing unit 8 includes a plurality of roller pairs and a plurality of guides. The reversing unit 8 selectively delivers the one-sided sheet P to the duplex print unit 7 in the duplex print mode, as stated above, directly delivers it to the outside, or reverses it and then delivers it to the outside. Sheet separating portions 45 and 46 are associated with the sheet cassettes 13 and 14, respectively. The sheet separating portions 45 and 46 each pay out the top sheet P from the sheet cassette 13 or 14 while separating it from the underlying sheets P. Image transfer brushes or image transferring means 47, 48, 49 and 50 are positioned between the opposite runs of the belt 3 and face the drums 4Y, 4M, 4C and 4K, respectively.

In operation, when a print command is input on an operation panel, not shown, a drive source, not shown, causes the drums 4Y through 4K to rotate clockwise, as viewed in FIG. 1. The chargers 80Y through 80K, to which a bias is applied from a power source not shown, uniformly charge the drums 4Y through 4K, respectively. The optical writing unit 6 scans the charged surface of each of the drums 4Y through 4K with a laser beam in accordance with Y, M, C or K image data, thereby forming a latent image. The developing devices 5Y through 5K each include a developing sleeve or developer carrier, not shown, and are driven by a drive source not shown. The developing sleeves respectively develop the latent images formed on the drums 4Y through 4K to thereby produce a Y, an M, a C and a K toner image.

One paper sheet P is fed from selected one of the sheet cassettes 13 and 14 to a registration roller pair 51 positioned upstream of the drum unit 2Y in the direction of sheet feed. In the illustrative embodiment, a sheet may also be fed from the manual feed tray 15 by hand. In any case, the registration roller pair 51 once stops the sheet P and then drives it toward the belt 3 such that the leading edge of the sheet P meets the leading edges of the toner images formed on the drums 4Y through 4K. The belt 3 conveys the sheet P via the consecutive image transfer positions. At this instant, a roller 52 charges the belt 3 in order to electrostatically retain the sheet P on the belt 3.

The image transfer brushes 47 through 50 transfer the Y, M, C and K toner images from the drums 4Y through 4K to the sheet P one above the other. As a result, a full-color toner image is formed on the sheet P. The fixing device 9 fixes the full-color toner image on the sheet P with heat. The sheet P coming out of the fixing device 9 is selectively reversed and then driven out to the print tray 12 or driven out straight via the reversing unit 8 in accordance with the mode selected.

Specifically, when the duplex print mode is selected, the sheet P carrying the toner image on one side thereof and coming out of the fixing device 9 is introduced into the reversal path 44 of the reversing unit 8 and switched back thereby. The sheet P is then driven into the duplex print unit 7 again fed to the image forming station, so that another full-color image is formed on the other side of the sheet P.

When a three-color print mode is selected, a Y, an M and a C toner images are formed and transferred to the sheet P one above the other. Further, when a black-and-white print mode is selected, only a K toner image is formed and transferred to the sheet P.

A first embodiment of the fixing device 9 in accordance with the present invention will be described in detail with reference to FIG. 2. As shown, the fixing device 9 fixes a toner image 33 transferred to the sheet P and brought to a nip 28 for fixation. The fixing device 9 includes an endless belt 23 passed over a fixing roller or rotary body 21 and a stationary heating member 22. A motor (M) 29 causes the fixing roller 21 to rotate. A press roller or pressing member 24 is positioned below the belt 23 and pressed against the belt 23 between the fixing roller 21 and the heating member 22. The belt 23 and press roller 24 form the nip 28 therebetween.

Figure 3:
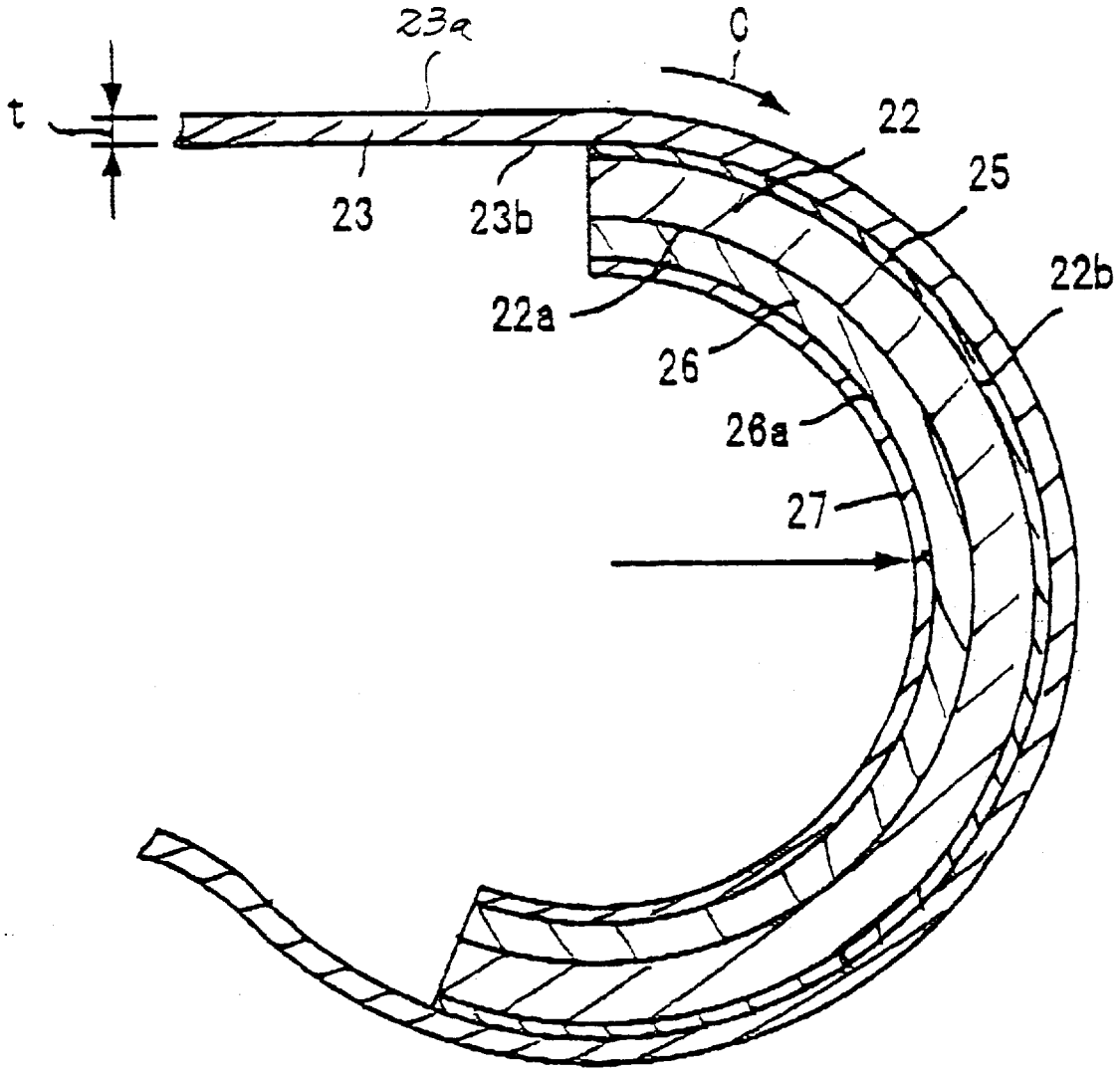
FIG. 3 is an enlarged section showing a heating member included in the first embodiment together with members adjoining it.

The belt 23 includes an endless base formed of heat-resistant resin or metal. The heat-resistant resin may be polyimide, polyamide or polyether keton (PEEK) by way of example. The metal may be nickel, aluminum or iron by way of example. As shown, the belt 23 has a thickness t as small as 100 $\mu$m or below. The surface 23*a* of the belt 23, which contacts the sheet P and toner, needs a parting ability and should preferably be highly resistant to heat and highly durable. In light of this, the surface 23*a* is coated with fluorocarbon resin, highly partible silicone rubber or similar heat-resistant parting layer although not shown in FIG. 3. For example, when fluorocarbon resin is used, it is coated on the surface 23 by, e.g., spraying and then melted by heat. The highly partible silicone rubber should preferably have rubber hardness of 25° to 65° in terms of JIS (Japanese Industrial Standards) A-scale and a thickness of 100 $\mu$m to 300 $\mu$m from a fixing ability and thermal response standpoint.

Figure 2:
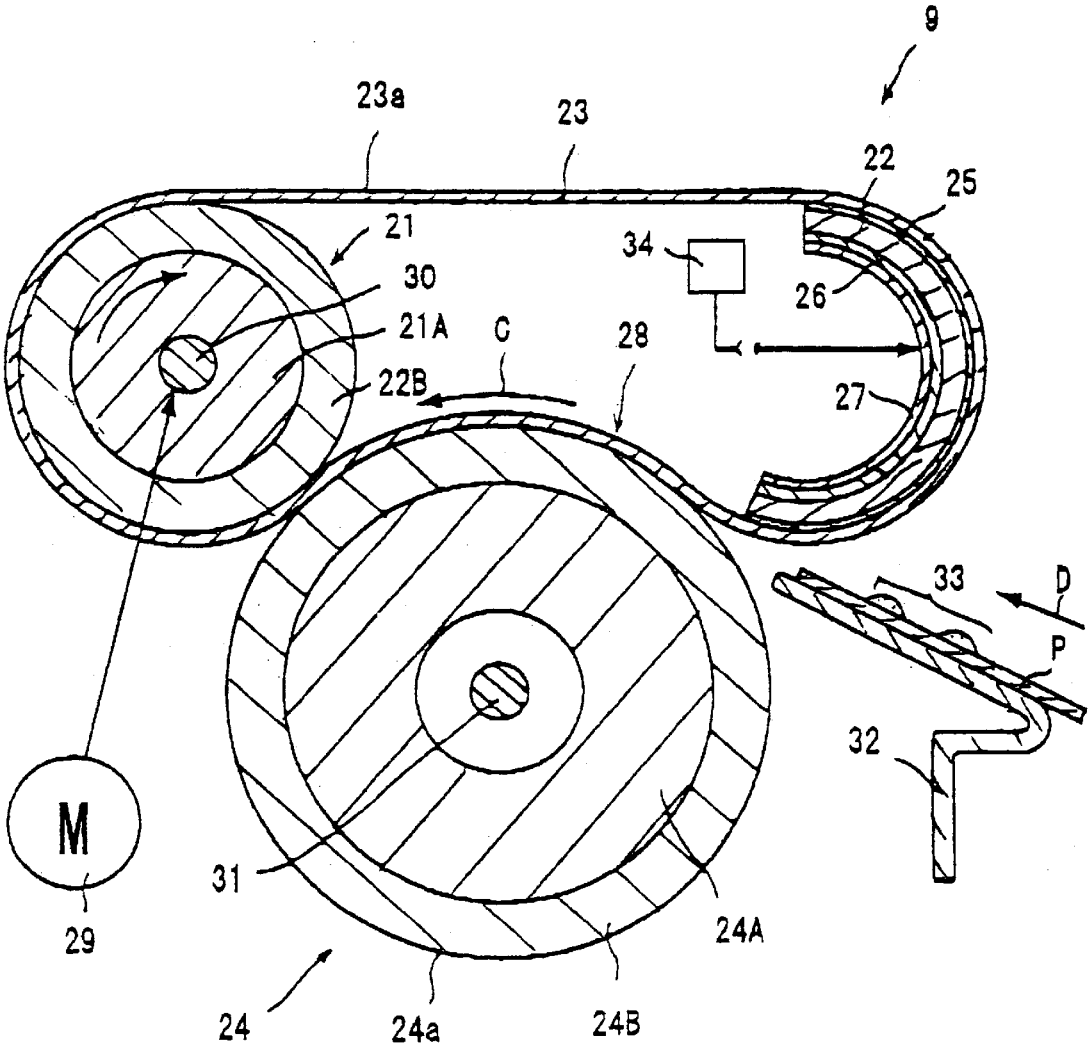
FIG. 2 is an enlarged section showing a first embodiment of the fixing device in accordance with the present invention.

As shown in FIG. 2, the fixing roller 21 includes a shaft 30 and a core 21*a* rotatable integrally with each other. A heat-insulating elastic member 22B covers the surface of the core 21A for guaranteeing a sufficient nip width and is formed of, e.g., foam silicone rubber. The elastic member 22B has a sufficient thickness that is about 15% to about 20% of the diameter of the fixing roller 21.

The press roller 24 is generally made up of a shaft 31, a core 24A freely rotatably mounted on the shaft 31, and a parting layer 24B. The parting layer 24B is formed of, e.g., fluorocarbon resin or highly partible silicone rubber. The core 24A is formed of, e.g., aluminum, stainless steel or carbon steel. In the illustrative embodiment, to promote parting of the sheet P from the belt 23, the press roller 24 has a higher hardness than the fixing roller 21 while the nip between the belt 23 and the press roller 24 faces downward. In the illustrative embodiment, the parting layer 24B has a thickness less than 7% of the diameter of the press roller 24 and has a hardness of 40 Hs in terms of JIS A-scale.

The heating member 22 has a length greater than the width of the sheet P and is positioned in such a manner as to lie down in the widthwise direction of the sheet P. The heating member 22 has a substantially semicircular cross-section and is affixed to a base, not shown, positioned above a guide plate 32. The guide plate 32 is positioned upstream of the nip 28 in a direction of sheet conveyance D. The heating member 22 supports a resistance heating body (simply heating body hereinafter) 27 via an electric insulation layer 26. The heating body 27 is formed on the surface 22*a* of the heating member 22 opposite to the surface 22*b* that contacts the belt 24. Let the sides 22*a* and 22*b* be referred to as an inner surface and an outer surface or contact surface hereinafter. The heating body 27 is connected to a power source 34.

Figure 4:
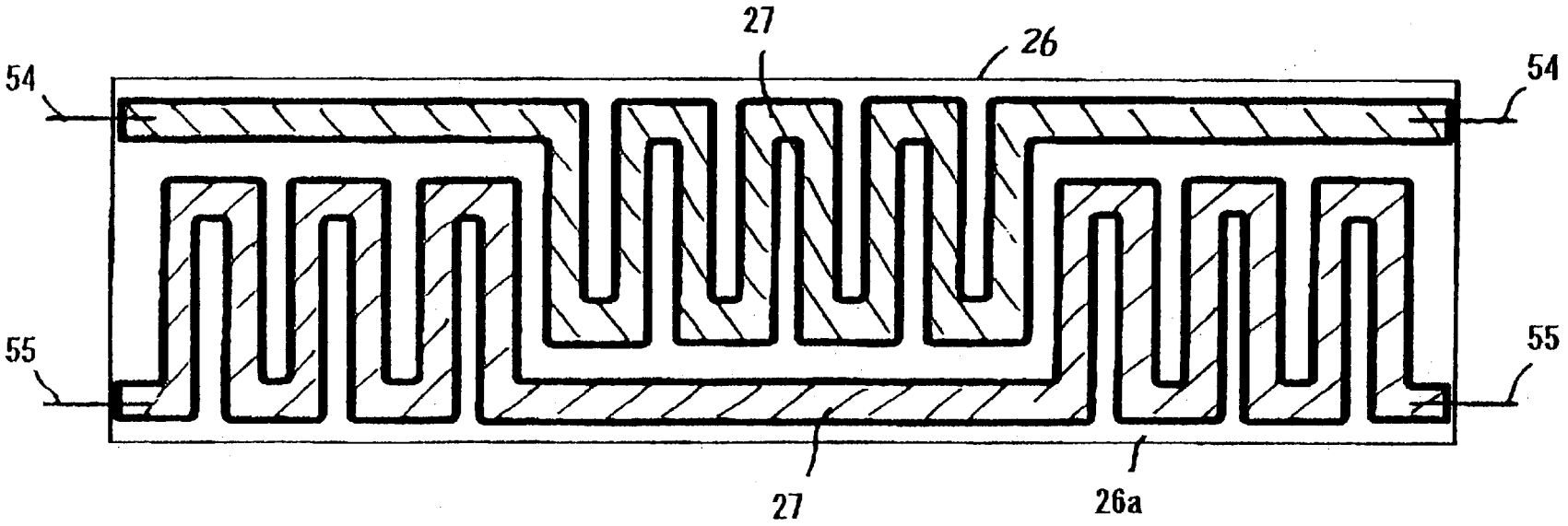
FIG. 4 is a developed view showing a specific configuration of resistance heating bodies provided on the heating member.

More specifically, as shown in FIG. 4, the heating body 27 is implemented as two heating bodies formed on the inner surface 26*a* of the insulation layer 26 in a labyrinth pattern each. Each heating body 27 is connected to the power source 34 via a respective terminal portion 54 or 55 and controlled independently of the other heating body 27. The insulation layer 26 electrically isolates the heating bodies 27 from the heating member 22. The power source 34 causes the heating bodies 27 to generate heat and thereby heat the heating member 22. The heating member 22 can be provided with any suitable heat distribution in accordance with the pattern of the heating bodies 27. Ideally, from the safety standpoint, another insulation layer 26 should preferably be positioned inward of the heating bodies 27 such that the two insulation layers 26 sandwich the heating bodies 27.

At least the outer surface 22*b* of the heating member 22 is curved and therefore exerts a minimum of resistance on the belt 23. Considering the uniform heat transfer from the heating bodies 27 to the belt 23, it is preferable that the heating member 22 has a uniform thickness. In this sense, both of the outer surface 22*b* and inner surface 22*a* should preferably be curved. It is to be noted that when temperature is apt to rise at the axially opposite ends of the heating member 22, the heating member 22 may be thickened at the above ends. The heating member 22 is formed of aluminum, carbon steel or stainless steel by way of example.

A low-friction layer 25 intervenes between the outer surface 22*b* of the heating member 22 and the inner surface 23*b* of the belt 23 in order to reduce the wear of the member 22 and that of the belt 23. While the low-friction layer 25 may be provided on either one of the surfaces 22*b* and 23*b*, it should preferably be provided on the surface 22*b* for reducing an area. The low-friction member 25 should preferably be formed of Teflon or similar material highly resistive to heat and durable.

When the power source 34 feeds power to the heating bodies 27 and the motor 29 is driven, the heating member 22 heats the belt 23, which is moved in a direction C, at a position upstream of the nip 28. The belt 23 therefore heats the toner image 33 carried on the sheet P and thereby fixes it on the sheet P.

In the illustrative embodiment, the heating member 22 with the heating bodies 27 is fixed in place. This protects the heating bodies 27 and terminal portions 54 and 55 from wear and insures stable contact thereof. Even when the heating bodies 27 are controlled independently of each other, friction at the terminal portions 54 and 55 does not have to be taken account of because the heating member 22 does not rotate.

As stated above, the illustrative embodiment applies a planar heating system to a belt type fixing device as a heat source. This solves wear and other problems ascribable to sliding movement to occur at the terminal portion of a conventional roller type fixing device. The stationary heating member 22 allows sufficient power to be stably fed to the resistance heating bodies 27 and thereby stabilizes heat transfer to the toner image 33 at the nip 28, enhancing reliable fixation. Further, the heating bodies 27 are printed on the insulation layer 26 and supported by the heating member 22. The fixing device is therefore lower in cost than a fixing device using a plurality of halogen lamps.

Figure 5:
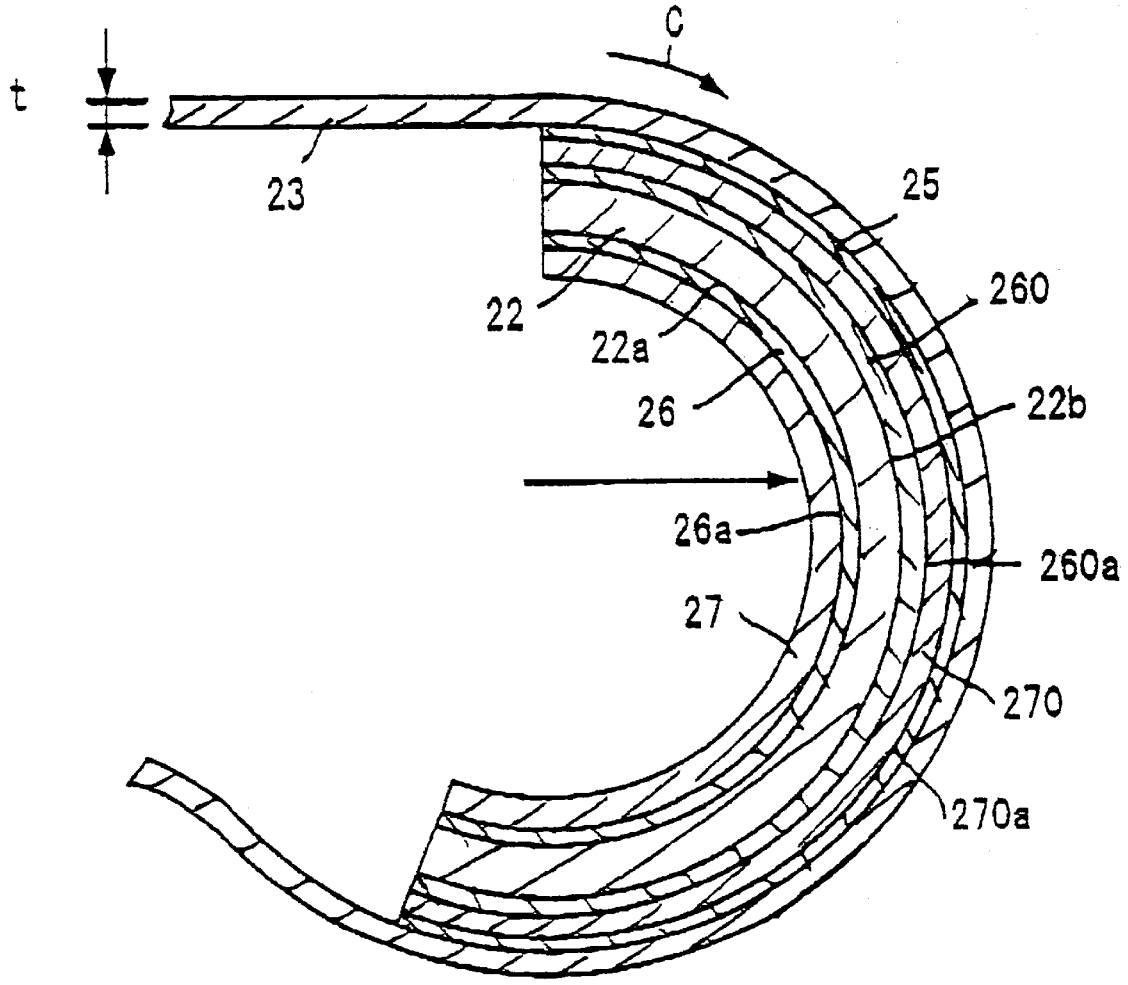
FIG. 5 is an enlarged section showing a second embodiment of the fixing device in accordance with the present invention.

Reference will be made to FIG. 5 for describing a second embodiment of the fixing device in accordance with the present invention. As shown, the resistance heating body 27 and a resistance heating body 270 are respectively formed on the outer surface 22*b*, which contacts the belt 23, and the inner surface 22*a* of the heating member 22 and controlled independently of each other. An electric insulation layer 260 intervenes between the outer surface 22*b* of the heating member 22 and the heating body 270. The heating body 270, like the heating body 27, is formed on the outer surface 260*a* of the insulation layer 260 in a labyrinth pattern. In the illustrative embodiment, the heating bodies 27 and 270, which are formed on both sides of the heating member 22, may not be patterned in labyrinth, but may be painted over the entire inner surface 26*a* of the heating body 26 and the entire outer surface 260*a* of the heating body 260, respectively. However, the labyrinth pattern is more desirable because it allows the temperature distribution to be easily varied.

In the illustrative embodiment, the low-friction layer 25 intervenes between the outer surface 270*a* of the heating body 270 and the inner surface 23*b* of the belt 23 because the belt 23 contacts the surface 270*a*. While the low-friction layer 25 may be provided on either one of the surfaces 270*a* and 23*b*, it should preferably be provided on the surface 270*a* for reducing an area. From the safety standpoint, another insulation layer 270 should preferably be so positioned as to sandwich the heating body 260 between it and the above insulation layer 270.

As stated above, the heating bodies 27 and 270 are positioned on opposite sides of the stationary heating member 22 and can be controlled independently of each other. This not only broadens the control width over the heating member 22, but also allows the heat distribution of the heating member 22 to be easily controlled. Further, the heating bodies 27 and 270 are printed on the insulation layers 26 and 260 and supported by the heating member 22. The fixing device is therefore lower in cost than a fixing device using a plurality of halogen lamps.

To determine the shape of the heating member 22, it is necessary to design the length and diameter of the arc. Factors for designing the length and diameter of the arc are (1) the rigidity of the heating member 22, (2) the ability to feed heat required of the belt 23, and (3) friction between the belt 23 and the heating member 22. As for the factor (1), a small length and a small diameter are desirable for increasing rigidity against bending. As for the factor (2), a great length is desirable for extending the duration of contact of the belt 23 and heating member 22. On the contrary, as for the factor (3), a great length increases resistance ascribable to friction and thereby increases a load on belt conveyance and lowers durability. In this manner, the factors (1) through (3) are in a tradeoff relation and must be fully taken account of at the time of design to optimize the shape of the heating member 22.

Figure 6:
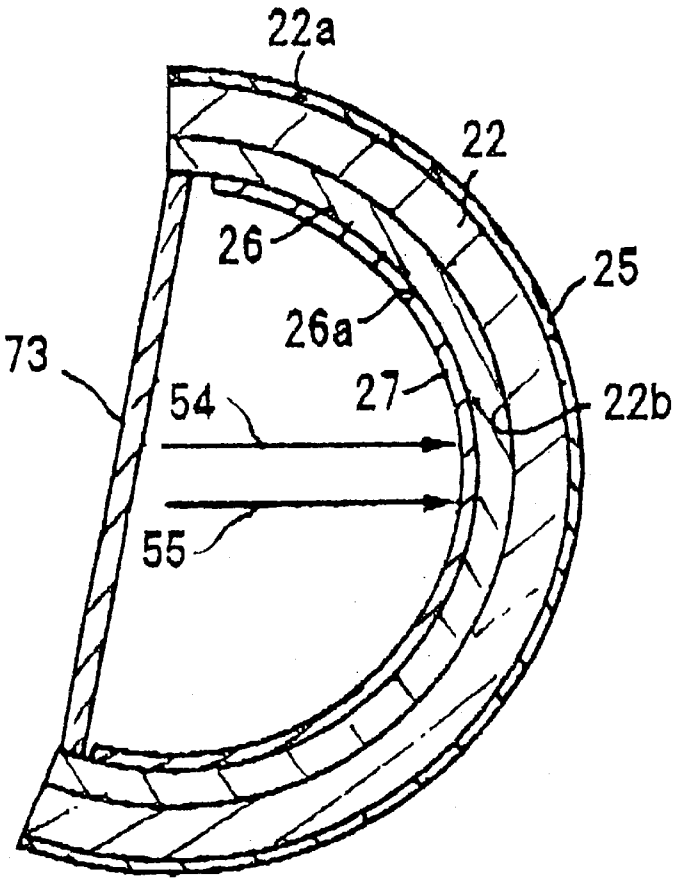
FIG. 6 is a section showing a specific configuration of a heating member included in the second embodiment.

FIG. 6 shows a specific reinforcing member 73 that prevents the heating member 22 from bending radially inward. The reinforcing member 72 is implemented as a rod or a bar formed of an insulating material and does not contact the heating body 27. In practice, a plurality of reinforcing members 73 are positioned at intervals in the axial direction in such a manner as to support the heating member 22 at the inside of the insulation layer 26. The reinforcing member 73 increases the rigidity of the heating member 22 and thereby prevents it from bending radially inward. Bending of the heating member 22 would cause the belt 23 to shake or would vary the moving speed of the belt 23.

Figure 7:
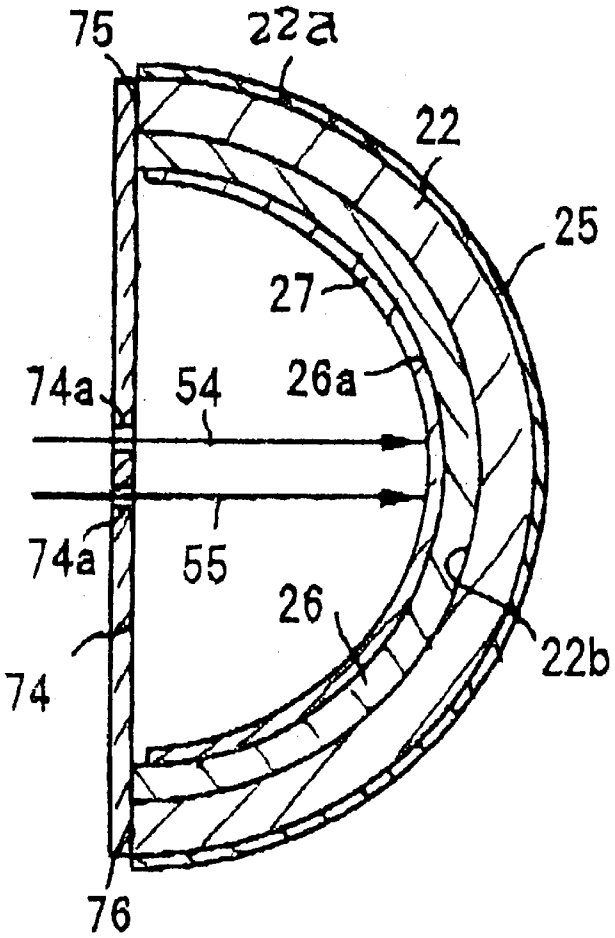
FIG. 7 is a section showing another specific configuration of the heating member.

FIG. 7 shows another specific reinforcing member 74 affixed to the upper end face 75 and the lower end face 76 of the heating member 22. The reinforcing member is implemented as a flat plate and formed of metal. In the illustrative embodiment, the reinforcing member 74 formed of metal is affixed to the heating member 22 also formed of metal by spot welding. Alternatively, the reinforcing member 74 maybe fastened to the heating member 22 by screws. Further, the reinforcing member 74 and heating member 22 may be mated with each other by a projection and recess scheme. The reinforcing member 74 is formed with holes 74*a* for passing the terminal portions 54 and 55.

The reinforcing member 74 implemented as a flat plate increases the rigidity of the heating member 22 and thereby prevents it from bending radially inward. Bending of the heating member 22 would cause the belt 23 to shake or would vary the moving speed of the belt 23. In addition, the reinforcing member 74 closes the open end of the arc of the heating member 22 and thereby obstructs heat radiation from the arc. This contributes to energy saving.

Figure 8:
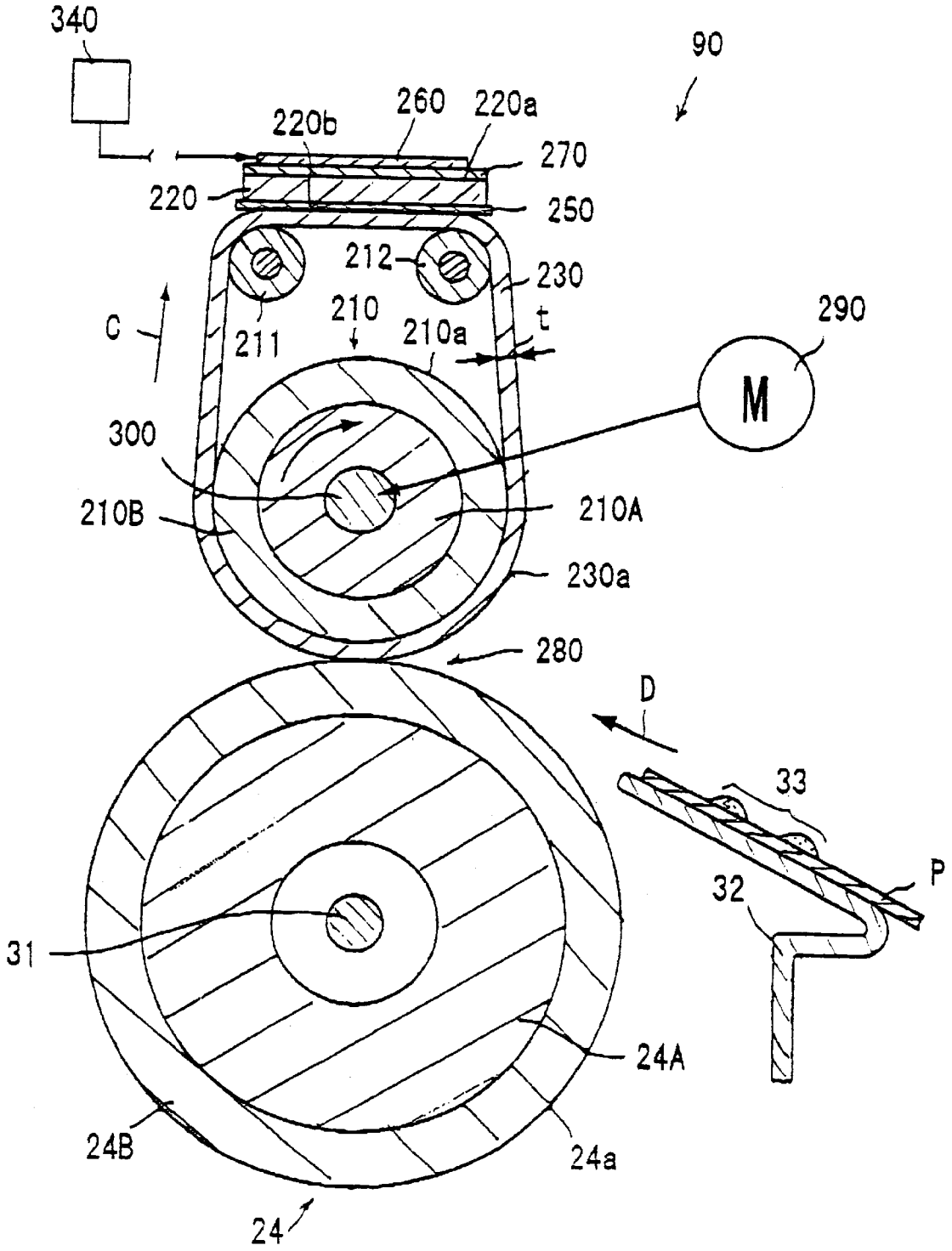
FIG. 8 is an enlarged section showing a third embodiment of the fixing device in accordance with the present invention.

FIG. 8 shows a third embodiment of the fixing device in accordance with the present invention that may be substituted for the first embodiment. As shown, the fixing device, generally 90, fixes the toner image 33 transferred to the sheet P and brought to a nip 280. The fixing device 90 includes a belt 230 loosely passed over a fixing roller or rotary body 210 and auxiliary rollers or auxiliary rotary members 211 and 212, which are freely rotatable. A motor (M) 290 causes the fixing roller 210 to rotate. The press roller or pressing member 24 is positioned below the belt 230 and pressed against the belt 230. The belt 230 and press roller 24 form the nip 280 therebetween. The auxiliary rollers 211 and 212 are positioned above the fixing roller 210 and arranged side by side in the radial direction of the roller 210.

The fixing roller 210 is so positioned as not to exert tension on the inner surface of the belt 230. The fixing roller 210 includes a core 210A rotatable integrally with a shaft 300. A surface layer 210B covers the surface of the core 210A. The toner image 33 on the sheet P is fixed by heat and pressure at the nip 280. The belt 230 is identical in basic configuration with the belt 23 and will not be described specifically in order to avoid redundancy.

A heating member 220 is affixed to a frame, not shown, at the outside of the belt 230 and held in contact with the belt 230 in a plane. A resistance heating body 260 is positioned on the surface 220*a* of the heating member 220 opposite to the surface 220*b* contacting the belt 230. An electric insulation layer 270 intervenes between the heating body 260 and the surface 220*a*. Let the surfaces 220*a* and 220*b* be referred to as an upper surface and a lower surface, respectively, hereinafter. A power source 340 feeds power to the heating body 260 and thereby causes it to generate heat for heating the heating member 220.

The heating member 220 heats the belt 230 in contact with the surface 230*a* of the belt 230. The heating member 220 includes a thin, flat base formed of aluminum, carbon steel, stainless steel or similar metal. The heating member 220 contacts and slides on the belt 230 in a condition that frees the belt 230 from noticeable wear. In the illustrative embodiment, the heating member 210 extends over the distance between the auxiliary rollers 211 and 212. A low-friction member 250 is positioned between the lower surface 220*b* of the heating member 220 and the surface 230*a* of the belt 230 for reducing the wear of the heating member 220 and that of the belt 230. While the low-friction layer 250 may be provided on either one of the surfaces 220*b* and 230*a*, it should preferably be provided on the surface 220*b* for reducing an area.

In practice, two heating bodies 270 are also formed on the insulation layer 260 in the labyrinth pattern shown in FIG. 4 and controlled independently of each other.

When the power source 340 applies power to the heating body 260 and the motor 290 is driven, the belt 230 moves in the direction C while being heated by the heating body 260 at a position upstream of the nip 280. The belt 230 therefore fixes the toner image 33 on the sheet P with heat.

As stated above, the heating member 220 with the heating body 270 is planar and contacts the belt 230 in a plane. The heating member 220 therefore needs a minimum of space and contacts the belt 230 over a broad area, compared to a roller or an arcuate heating member. This promotes efficient heating of the belt 230. The belt 230 is passed over the fixing roller 210 and auxiliary rollers 211 and 212 positioned above the roller 210 and therefore extends in the up-and-down direction. The fixing device 90 is therefore reduced in size in the direction of sheet conveyance D. In addition, because the belt 230 is loosely passed over the rollers 210, 211 and 212, the wear of the belt 230 and that of the heating member 220 are reduced.

Further, the heating member 220 does not rotate and therefore frees the heating bodies 270 and terminal portions 54 and 55, FIG. 4, from wear while insuring stable contact thereof. Even when the heating bodies 270 are controlled independently of each other, friction at the terminal portions 54 and 55 does not have to be taken account of because the heating body 220 does not rotate. The illustrative embodiment also applies a planar heating system to a belt type fixing device as a heat source. This solves wear and other problems ascribable to sliding movement to occur at the terminal portion of a conventional roller type fixing device. The stationary heating member 220 allows sufficient power to be stably fed to the resistance heating bodies 270 and thereby stabilizes heat transfer to the toner image 33 at the nip 280, enhancing reliable fixation.

Further, the heating bodies 270 are printed on the insulation layer 260 and supported by the heating member 220. The fixing device is therefore lower in cost than a fixing device using a plurality of halogen lamps.

Figure 9:
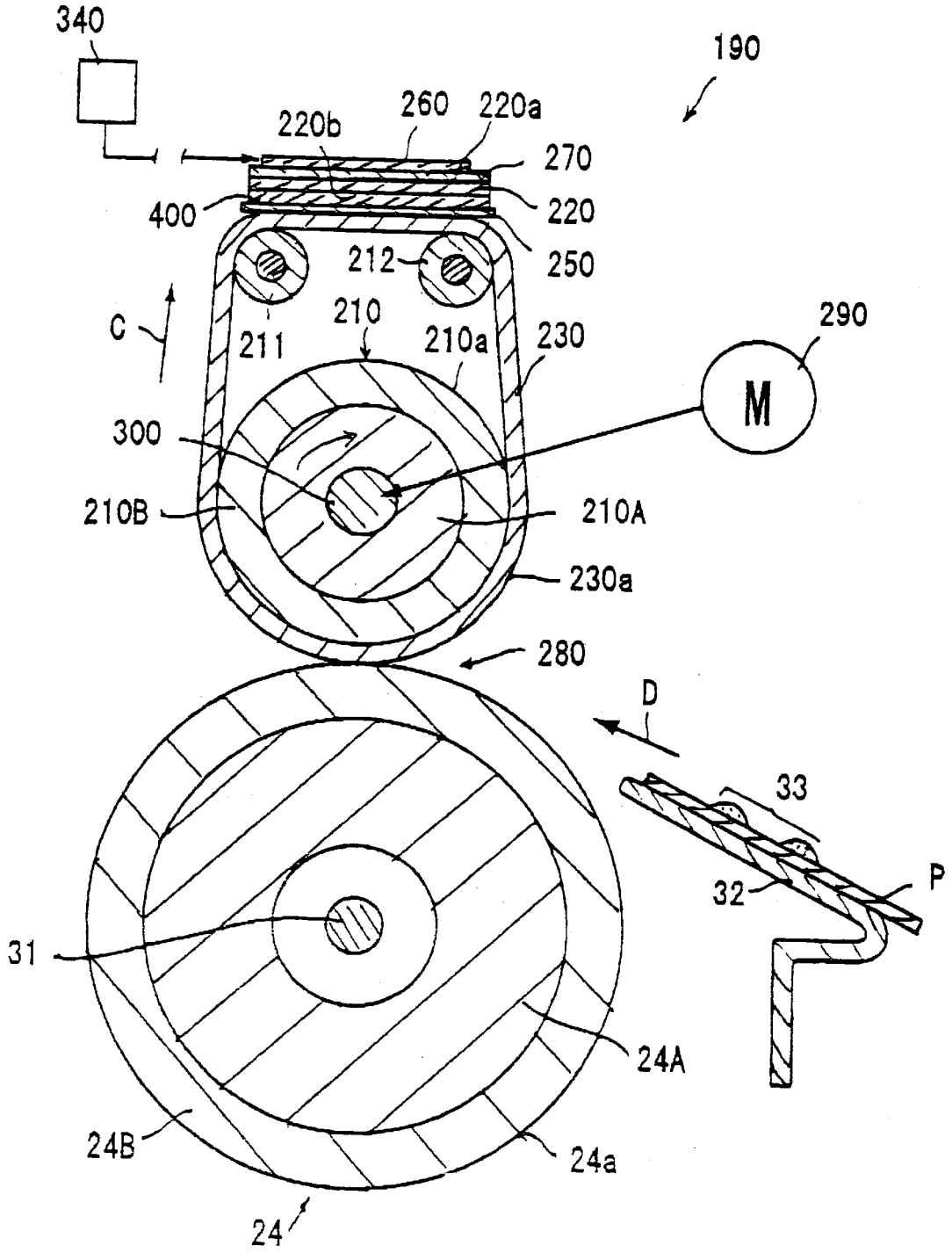
FIG. 9 is an enlarged section showing a fourth embodiment of the fixing device in accordance with the present invention.

Reference will be made to FIG. 9 for describing a fourth embodiment of the present invention. As shown, a fixing device, generally 190, includes a magnet or magnetic force generating member 400 positioned on the lower surface 220*b* of the heating body 220. The magnet 400 plays the role of attracting means. The low-friction member 250 is positioned between the lower surface 400*a* of the magnet 400, which faces the belt 230, and the surface 230*a* of the belt 230. While the low-friction layer 250 may be provided on either one of the surfaces 230*a* and 400*a*, it should preferably be provided on the surface 400*a* for reducing an area to occupy. The belt 230 includes an endless base formed of a magnetic material, preferably nickel or similar ferromagnetic metal.

When the fixing roller 210 causes the belt 230 to move, the magnet 400 attracts the belt 230 toward the heating body 220. The magnet 400 therefore insures stable contact of the belt 230 and heating member 220 and allows heat to be stably transferred from the heating member 220 to the belt 230.

Figure 10:
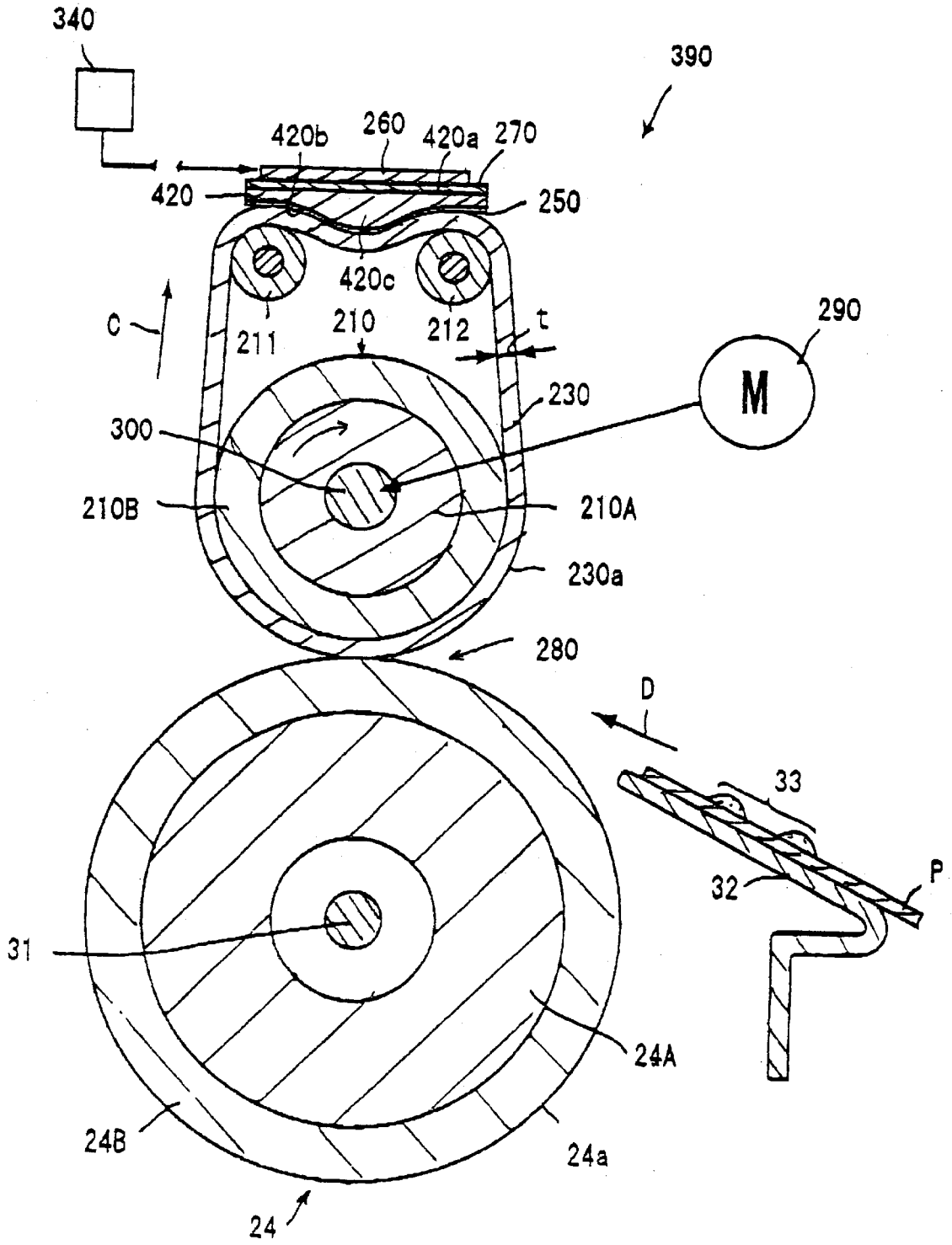
FIG. 10 is an enlarged section showing a fixing device including belt adhering means.

FIG. 10 shows a modified form of the fixing device 90 shown in FIG. 8. As shown, the modified fixing device, generally 390, is identical with the fixing device 90 except for a heating member 420. The heating member 420 is positioned outside of the belt 230 and affixed to a frame not shown. The heating member 420 includes an arcuate protuberance 420*c* for pressing the belt 230 inward. The protuberance 420*c* is positioned on the surface 420*b* of the heating member 420 opposite to the surface 420*a* that faces the belt 230. Let the surfaces 420*a* and 420*b* be referred to as an upper surface and a lower surface, respectively, hereinafter.

More specifically, the heating member 420 is positioned such that the protuberance 420*c* presses the belt 230 between the auxiliary rollers 211 and 212. The insulation layer 270 intervenes between the upper surface 420*a* and the heating body 260. When the power source 340 feeds power to the heating body 260, the heating body 260 generates heats and heats the heating member 420. The heating member 420 heats the belt 230 in contact with the surface 230*a* of the belt. The low-friction layer 250 is formed over the entire lower surface 420*b* of the heating member 420.

The protuberance 420*c* protruding from the lower surface 420*b* of the heating member 420 insures stable contact of the surface 420*b* and belt surface 230*a*. This allows heat to be stably transferred from the heating member 420 to the belt 230 and thereby enhances reliable fixation.

Figure 11:
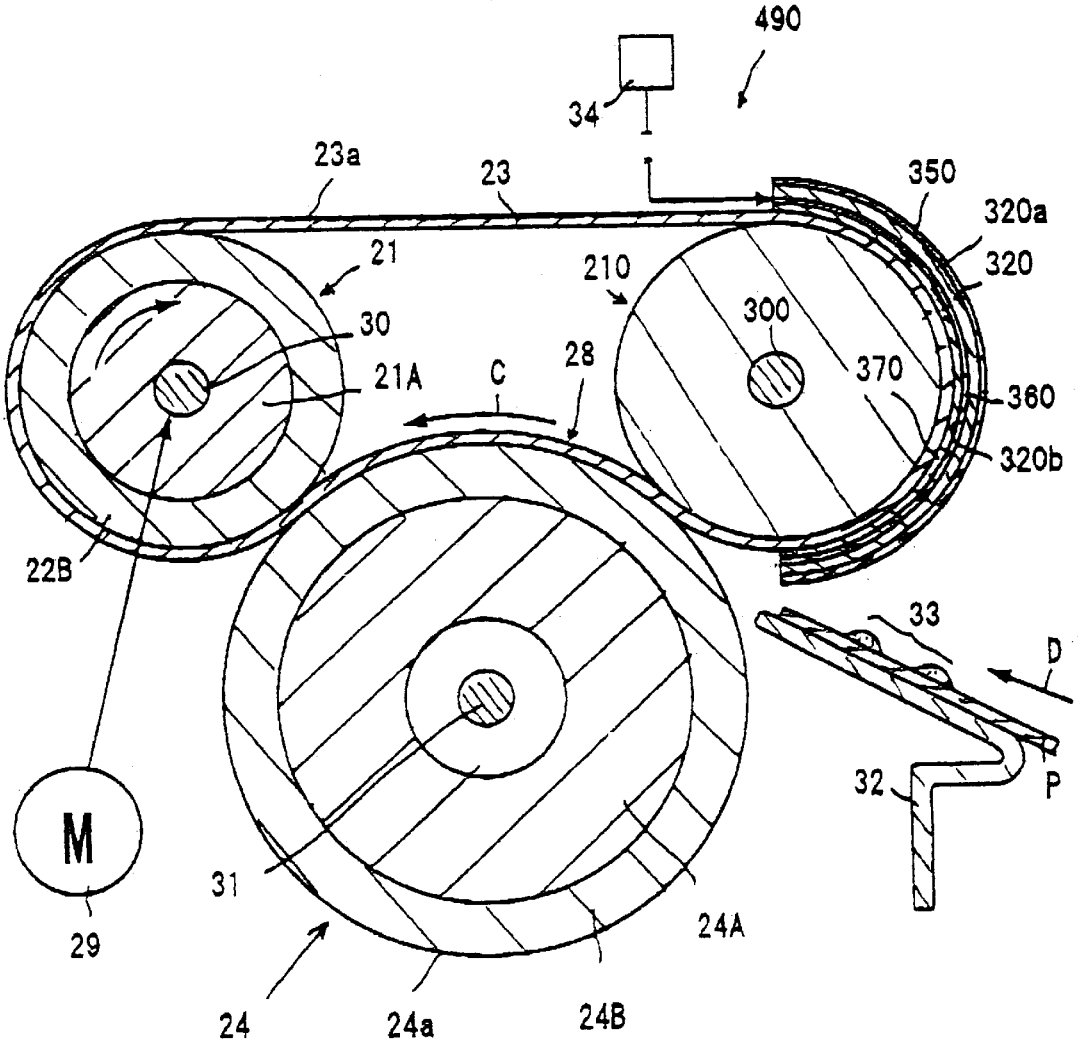
FIG. 11 is an enlarged view showing a fixing device including a heating member positioned outside of a fixing belt.

FIG. 11 shows a modification of the fixing device 9 described with reference to FIG. 2. As shown, the modified fixing device, generally 490, is identical with the fixing device 9 except that for a heating member 320. The heating member 320 is positioned outside of the belt 23. The fixing device 490 includes the belt 23 passed over the fixing roller 21 and a driven roller 210, which is formed of metal and freely rotatably mounted on a shaft 300. The motor 29 causes the fixing roller 21 to rotate. The press roller 24 is positioned below the belt 23 and pressed against the belt 23 between the fixing roller 21 and the driven roller 24. The belt 23 and press roller 24 form the nip 28 therebetween.

The heating member 320 is a thin, substantially arcuate member complementary in shape to part of the belt 23 passed over the driven roller 210. The heating member 320 includes a resistance heating body 370 positioned on its inner surface 320*b*, which contacts the belt 23, with the intermediary of an electric insulation layer 360. The power source 34 feeds power to the heating body 370 to thereby cause it to generate heat. The insulation layer 360 is formed of a material that allows the layer 360 to play the role of a low-friction layer at the same time. While the opposite surfaces 320a and 320*b* of the heating member 320 may not be coated at all, a heat insulation layer 350 should preferably be formed on each of the surfaces 320*a* and 320*b*. The heat insulation layer 350 protects a person who may accidentally touch the heating member 320 from a bum and obviates wasteful heat radiation from the member 320.

When the power source 34 applies power to the heating body 320 and the motor 29 is driven, the belt 23 moves in the direction C while being heated by the heating body 320 at a position upstream of the nip 28. The belt 230 therefore fixes the toner image 33 on the sheet P with heat and pressure.

The heating member 320 with the heating body 370 contacts the surface 23*a* of the belt 23 over its entire inner curved surface. The heating member 320 can therefore heat the belt surface 23*a* more efficiently than when heating it at the inside of the belt 23. Therefore, the fixing device 490 not only insures reliable fixation, but also reduces power to be fed to the heating body 370 for thereby saving energy.

While the driven roller 210 and heating member 320 both are formed of metal in the illustrative embodiment, the driven roller 210 should preferably be formed of an elastic material when consideration is given to the contact of the heating member 320 and belt 23. Also, considering the durability of the belt 23, a small gap should preferably be formed between the heating member 320 and the belt 23 although the gap would lower thermal efficiency. The small gap should be determined such that the belt 23 in movement does not contact the heating member 320 even when it shakes.

Figure 12:
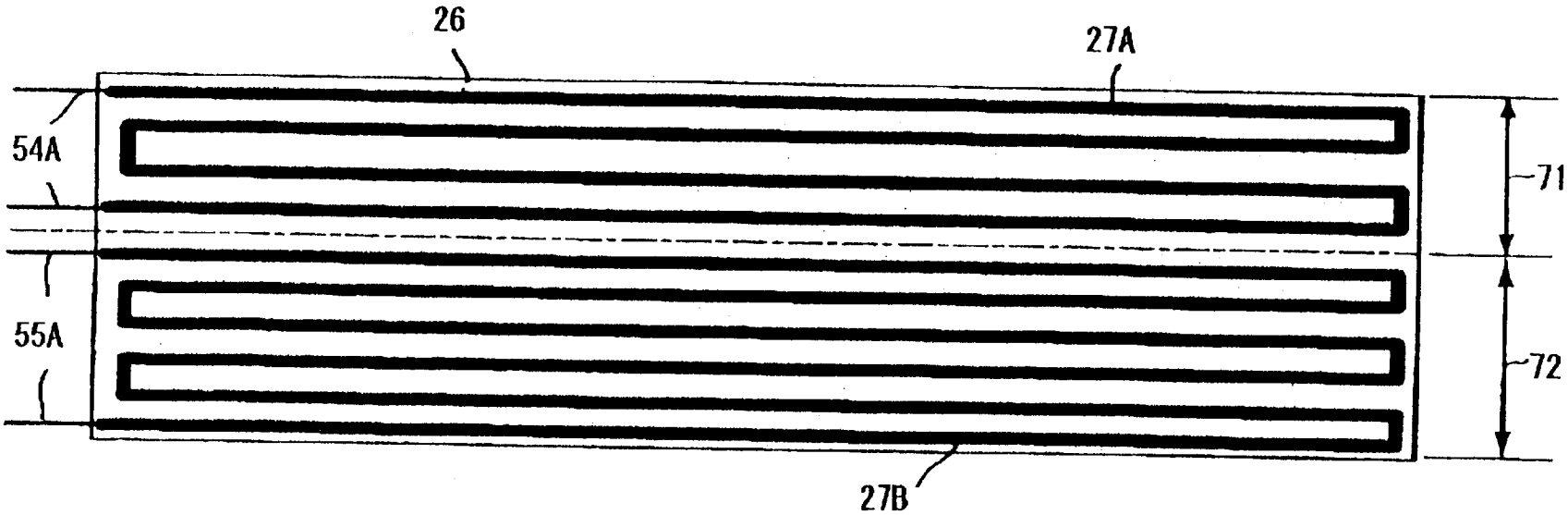
FIG. 12 is a developed view showing another specific configuration of resistance heating bodies.
Figure 13:
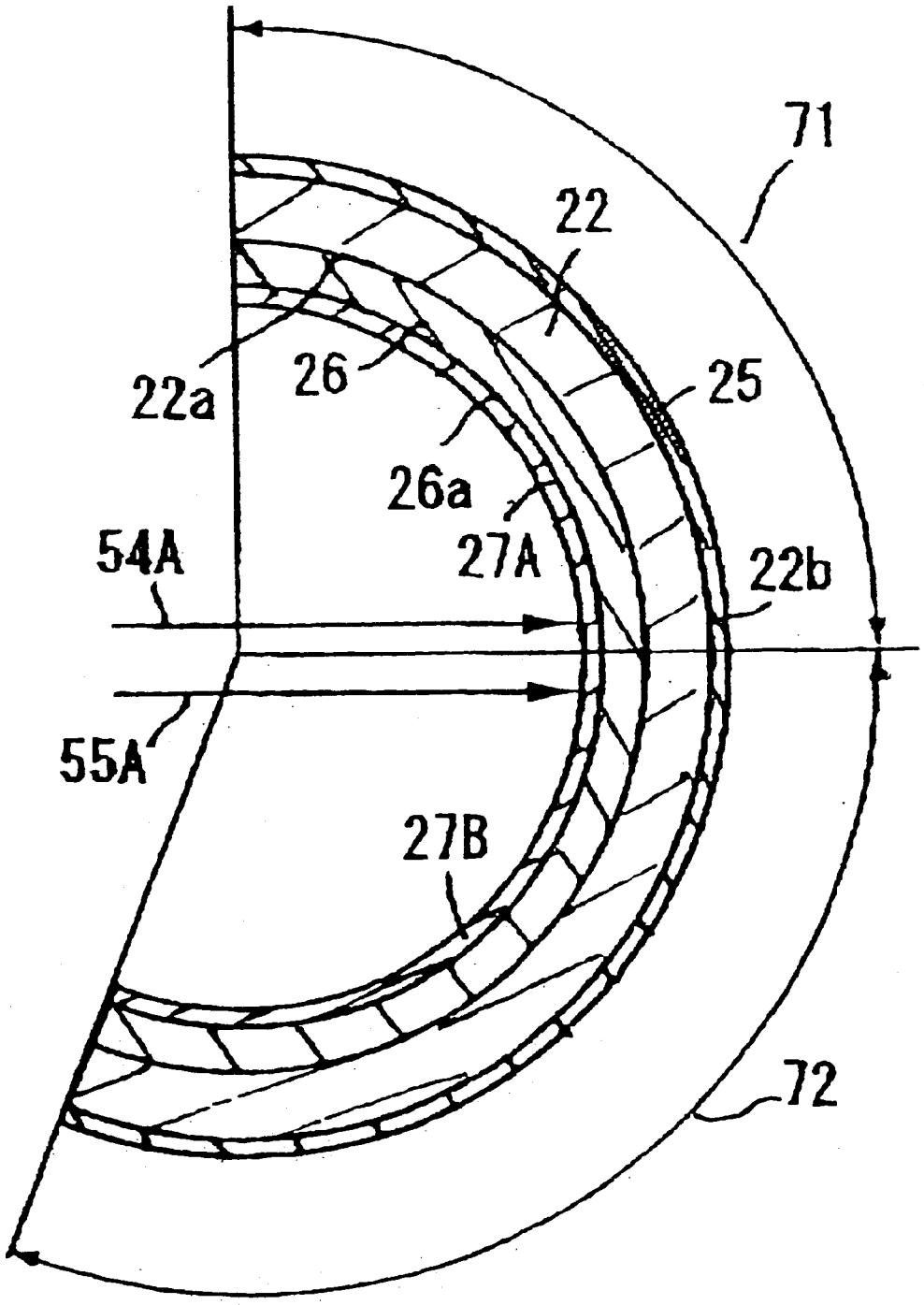
FIG. 13 is a section showing a heating member provided with the resistance bodies of FIG. 12.

FIGS. 12 and 13 shows another specific configuration of the heating bodies formed on the heating member 22, which is a substantially arcuate thin member. As shown, two heating bodies 27A and 27B are respectively patterned in the lower part 71 and the upper part 72 of the heating member 22. The parts 71 and 72 are respectively located at the upstream side and downstream side in the direction of movement of the belt 23. The insulation layer 26 electrically isolates the heating bodies 27A and 27B from the heating member 22. The power source 34 feeds power to the heating bodies 27A and 27B and thereby causes them to heat the heating member 22. The pattern 27B has a greater total area than the pattern 27A and therefore heats more than the pattern 27A when applied with power.

Assume that the heating body 27B closer to the nip 28 than the heating body 27A and the heating body 27A are a main heater and a subheater, respectively. Then, to warm up the fixing device from room temperature, the power source 34 feeds power to both of the main and subheaters 27B and 27A. At this instant, a thermistor or similar temperature sensor is positioned to contact the outer surface of the heating member 22 via the belt 23 within the region 72. After temperature represented by the output of the temperature sensor has risen to a preselected value, only the main heater 27B is ON/OFF controlled to thereby maintain the preselected temperature. When the fixing temperature drops due to repeated image formation, the subheater 27A is energized in addition to the main heater 27B.

Figure 14:
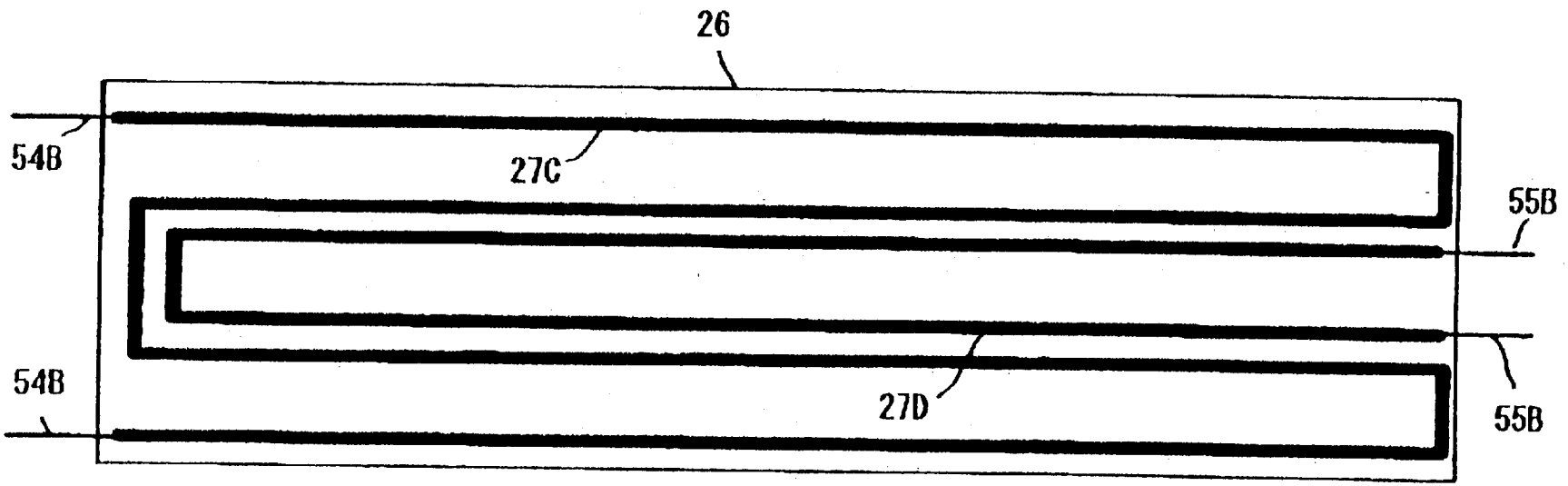
FIG. 14 is a developed view showing a further specific configuration of the resistance heating bodies.

Just after the last image formation, heat remains in the fixing device even at the time of warm-up. Then, whether or not only the main heater 27B suffices is determined on the basis of the output of the temperature sensor. If the answer of this decision is positive, then the power source 34 feeds power only to the main heater 27B; if otherwise, it feeds power to both of the main and subheaters 27B and 27B. The control described above optimizes power to be applied to the main and subheaters 27B and 27A. As shown in FIG. 14, the heating bodies 27A and 27B isolated from each other in the up-and-down direction may be replaced with heating bodies 27C and 27D that are patterned in a zigzag fashion, if desired.

In each of the first to fourth embodiments, the low-friction layer 25 or 250 intervenes between the belt 23 or 230 and the heating member 22 or 220, reducing the wear of the belt 23 or 230 and the member contacting it.

In the embodiments shown and described, the fixing roller or the press roller is not provided with heating means. Alternatively, the press roller may accommodate heater therein. Specifically, although the temperature of the press roller sequentially rises due to heat transferred from the belt, the heater inside the press roller allows the temperature of the press roller to be controlled independently. This not only stabilizes the gloss of an image and fixation, but also promotes rapid temperature elevation of the fixing device at the time of warm-up.

The fixing roller, belt and press roller each may be provided with an elastic layer so as to follow the irregular surface of the sheet P carrying a toner image thereon. Such a roller or a belt can therefore closely contact the sheet P and therefore enhances image quality. More specifically, when any one of the rollers and belt is formed of a rigid material, it does not follow the irregularity of the sheet P, resulting in irregularity in gloss or similar defect. This is particularly true with a color printer, as distinguished from a monochromatic printer.

Japanese Patent Laid-Open Publication Nos. 8-76620 and 9-44014, for example, each teach a particular elastic layer formed on a film itself. This configuration, however, brings about a problem that when the elastic layer is thin, the rigidity of a fixing roller and that of a support member supporting a heater prevent the elastic layer from fully following the irregularity of the sheet P. Another problem is that when the elastic layer is thick, the thermal capacity of the film itself increases and critically extends the warm-up time because heat is sequentially transferred from a heat source to the surface of the film via the elastic layer. Therefore, the elastic layer provided on each of the fixing roller, belt and press roller successfully achieves both of high image quality and energy saving.

In summary, it will be seen that the present invention provides a fixing device having various unprecedented advantages, as enumerated below.

(1) A heating member for heating a fixing belt is held stationary and obviates friction between the heating member and a terminal portion connected to resistance heating bodies provided on the heating member. The stationary heating member allows sufficient power to be stably fed to the resistance heating bodies and thereby stabilizes heat transfer to a toner image at a nip for fixation, enhancing reliable fixation. Even when the heating bodies are controlled independently of each other, consideration does not have to be given to the above friction. The fixing device is therefore simple in configuration.

(2) Before the belt arrives at the nip, the heating member, which has a semicircular cross-section, heats the belt over its entire area. Such a configuration of the heating member obviates wear and other problems particular to a roller type fixing device. The stationary heating member allows sufficient power to be stably fed to the resistance heating bodies and thereby stabilizes heat transfer to a toner image at the nip for fixation, enhancing reliable fixation.

(3) The heating bodies controllable independently of each other are provided on the side of the heating member opposite to the side that contacts the belt. This not only broadens the control width over the heating member, but also allows the heat distribution of the heating member to be easily controlled. Because the heating bodies are stationary, power can be easily, stably fed to them via a plurality of electrodes. The fixing device is therefore lower in cost than a fixing device using a plurality of halogen lamps for varying a heat distribution.

(4) The heating bodies are provided on opposite sides of the stationary heating member. This not only broadens the control width over the heating bodies, but also allows a desired heat distribution to be easily set if the heating bodies are controlled. This easily copes with temperature elevation at opposite ends and other problems. Because the heating bodies are stationary, power can be easily, stably fed to them via a plurality of electrodes.

(5) The heating member the heating bodies provided on its surface not contacting the belt contacts the belt in a plane. The heating member therefore needs a minimum of space and contacts the belt over a broad area, compared to a roller or an arcuate heating member. This promotes efficient heating of the belt.

(6) When the belt is formed of a magnetic material a magnetic force generating member attracts the belt toward the heating member and thereby stabilizes the contact of the belt and heating member. This insures stable heat transfer from the heating member to the belt and thereby enhances reliable fixation.

(7) A low-friction member intervenes between the surface of the heating member that contacts the belt and the belt, reducing the wear of the heating member and belt and thereby enhancing durability.

Various modifications will become possible for those skilled in the art after receiving the teachings of the present disclosure without departing from the scope thereof.

What is claimed is:

1. A fixing device for fixing a toner image formed on a recording medium conveyed to a nip for fixation, said fixing device comprising:

a rotary body;

a stationary heating member not forming the nip;

a fixing belt passed over said rotary body and said heating member; and a pressing member held in contact with said fixing belt;

wherein a resistance heating body is formed on said heating member with the intermediary of an electric insulation layer positioned between said resistance heating body and said fixing belt.

2. The fixing device as claimed in claim 1, wherein said heating member has a substantially semicircular cross-section and is positioned upstream of the nip in a direction in which the recording medium is conveyed.

3. The fixing device as claimed in claim 2, further comprising a low-friction layer positioned between a surface of said heating member that contacts said fixing belt and said belt.

4. The fixing device as claimed in claim 2, wherein said resistance heating body comprises a plurality of resistance heating bodies formed on a surface of said heating member opposite to a surface that contacts said fixing belt.

5. The fixing device as claimed in claim 4, further comprising a low-friction layer positioned between a surface of said heating member that contacts said fixing belt and said belt.

6. The fixing device as claimed in claim 2, said resistance heating body comprises a plurality of resistance heating bodies respectively formed on a surface of said heating member that contacts said fixing belt and a surface opposite to said surface and applied with power independently of each other.

7. The fixing device as claimed in claim 6, further comprising a low-friction layer positioned between a surface of said heating member that contacts said fixing belt and said belt.

8. The fixing device as claimed in claim 1, wherein said resistance heating body comprises a plurality of resistance heating bodies formed on a surface of said heating member opposite to a surface that contacts said fixing belt.

9. The fixing device as claimed in claim 8, further comprising a low-friction layer positioned between a surface of said heating member that contacts said fixing belt and said belt.

10. The fixing device as claimed in claim 1, said resistance heating body comprises a plurality of resistance heating bodies respectively formed on a surface of said heating member that contacts said fixing belt and a surface opposite to said surface and applied with power independently of each other.

11. The fixing device as claimed in claim 10, further comprising a low-friction layer positioned between a surface of said heating member that contacts said fixing belt and said belt.

12. The fixing device as claimed in claim 1, further comprising a low-friction layer positioned between a surface of said heating member that contacts said fixing belt and said belt.

13. A fixing device for fixing a toner image formed on a recording medium conveyed to a nip for fixation, said fixing device comprising:

a rotary body;

auxiliary rotary bodies not forming the nip;

a fixing belt passed over said rotary body and said auxiliary rotary bodies;

a pressing member held in contact with said fixing belt;

a heating member positioned outside of and contacting said fixing belt in a plane; and a resistance heating body formed on a surface of said heating member opposite to a surface that contacts said fixing belt with the intermediary of an electric insulation layer positioned between said resistance heating body and said fixing belt.

14. The fixing device as claimed in claim 13, wherein said fixing belt is formed of a magnetic material while a magnetic force generating member is positioned on the surface of said heating member that contacts said fixing belt.

15. The fixing device as claimed in claim 14, further comprising a low-friction layer positioned between a surface of said heating member that contacts said fixing belt and said belt.

16. The fixing device as claimed in claim 14, wherein said resistance heating body comprises a plurality of resistance heating bodies formed on the surface of said heating member opposite to the surface that contacts said fixing belt.

17. The fixing device as claimed in claim 16, further comprising a low-friction layer positioned between a surface of said heating member that contacts said fixing belt and said belt.

18. The fixing device as claimed in claim 13, wherein said resistance heating body comprises a plurality of resistance heating bodies formed on the surface of said heating member opposite to the surface that contacts said fixing belt.

19. The fixing device as claimed in claim 18, further comprising a low-friction layer positioned between a surface of said heating member that contacts said fixing belt and said belt.

20. The fixing device as claimed in claim 13, further comprising a low-friction layer positioned between a surface of said heating member that contacts said fixing belt and said belt.

21. In an image forming apparatus including a fixing device for fixing a toner image formed on a recording medium conveyed to a nip for fixation, said fixing device comprising:

a rotary body;

a stationary heating member not forming the nip;

a fixing belt passed over said rotary body and said heating member; and a pressing member held in contact with said fixing belt;

wherein a resistance heating body is formed on said heating member with the intermediary of an electric insulation layer positioned between said resistance heating body and said fixing belt.

22. In an image forming apparatus including a fixing device for fixing a toner image formed on a recording medium conveyed to a nip for fixation, said fixing device comprising:

a rotary body;

auxiliary rotary bodies not forming the nip;

a fixing belt passed over said rotary body and said auxiliary rotary bodies;

a pressing member held in contact with said fixing belt;

a heating member positioned outside of and contacting said fixing belt in a plane; and a resistance heating body formed on a surface of said heating member opposite to a surface that contacts said fixing belt with the intermediary of an electric insulation layer positioned between said resistance heating body and said fixing belt.

23. A fixing device for fixing a toner image formed on a recording medium conveyed to a nip for fixation, said fixing device comprising:

a rotary body;

auxiliary rotary bodies not forming the nip;

a fixing belt passed over said rotary body and said auxiliary rotary bodies;

a pressing member held in contact with said fixing belt;

a heating member positioned outside of and contacting said fixing belt in a plane; and a resistance heating body formed on a surface of said heating member opposite to a surface that contacts said fixing belt with the intermediary of an electric insulation layer, wherein said fixing belt is formed of a magnetic material while a magnetic force generating member is positioned on the surface of said heating member that contacts said fixing belt.

24. The fixing device as claimed in claim 23, further comprising a low-friction layer positioned between a surface of said heating member that contacts said fixing belt and said belt.

25. The fixing device as claimed in claim 23, wherein said resistance heating body comprises a plurality of resistance heating bodies formed on the surface of said heating member opposite to the surface that contacts said fixing belt.

26. The fixing device as claimed in claim 25, further comprising a low-friction layer positioned between a surface of said heating member that contacts said fixing belt and said belt.

27. The fixing device as claimed in claim 23, wherein said resistance heating body comprises a plurality of resistance heating bodies formed on the surface of said heating member opposite to the surface that contacts said fixing belt.

28. The fixing device as claimed in claim 27, further comprising a low-friction layer positioned between a surface of said heating member that contacts said fixing belt and said belt.

* * * * *